US009957097B2

(12) United States Patent
Parsons

(10) Patent No.: US 9,957,097 B2
(45) Date of Patent: May 1, 2018

(54) FOOD TRAY

(71) Applicant: ConAgra Foods RDM, Inc., Omaha, NE (US)

(72) Inventor: Steven M. Parsons, Alberta (CA)

(73) Assignee: ConAgra Foods RDM, Inc., Omaha, NE (US)

( * ) Notice: Subject to any disclaimer, the term of this patent is extended or adjusted under 35 U.S.C. 154(b) by 70 days.

(21) Appl. No.: 14/818,737

(22) Filed: Aug. 5, 2015

(65) Prior Publication Data

US 2016/0096674 A1 Apr. 7, 2016

Related U.S. Application Data

(63) Continuation of application No. 11/286,008, filed on Nov. 23, 2005, now Pat. No. 9,132,951.

(51) Int. Cl.

| | |
|---|---|
| ***B65D 81/34*** | (2006.01) |
| ***B65D 77/04*** | (2006.01) |
| ***B65D 21/02*** | (2006.01) |
| ***B65D 25/02*** | (2006.01) |
| ***B65D 43/02*** | (2006.01) |
| ***B65D 59/04*** | (2006.01) |
| ***B65D 43/06*** | (2006.01) |
| *B65D 81/32* | (2006.01) |

(52) U.S. Cl.

CPC ..... *B65D 81/3453* (2013.01); *B65D 21/0212* (2013.01); *B65D 25/02* (2013.01); *B65D 43/0204* (2013.01); *B65D 43/06* (2013.01); *B65D 59/04* (2013.01); *B65D 77/046* (2013.01); *B65D 81/3216* (2013.01); *B65D 2581/3404* (2013.01); *B65D 2581/3422* (2013.01); *B65D 2581/3425* (2013.01); *B65D 2581/3433* (2013.01); *B65D 2581/3456* (2013.01)

(58) Field of Classification Search

None

See application file for complete search history.

(56) References Cited

U.S. PATENT DOCUMENTS

| | | | | |
|---|---|---|---|---|
| 4,486,640 A * | 12/1984 | Bowen | H05B 6/6494 219/729 |
| 5,419,451 A * | 5/1995 | Bitel, Jr. | B65D 1/36 206/508 |
| 6,620,897 B1 * | 9/2003 | Smillie | C08F 10/00 428/513 |

(Continued)

*Primary Examiner* — Anthony J Frost

(74) *Attorney, Agent, or Firm* — Ryan T. Grace; Advent, LLP

(57) ABSTRACT

A food tray has a lower tray containing a first food product and an upper tray nested stably at least partly inside the lower tray, with the upper tray containing a second food product. An air permeable interface is provided between the upper tray and lower tray to allow venting of steam from the lower tray during cooking. A cover is provided for the food tray. Each of the lower tray and the upper tray are formed of a material that is suitable for use in a microwave or conventional oven. Various constructions may be used to create the air permeable interface, such as lugs, ledges and lips. The upper tray may sit above the lower tray. The trays are nested loosely for ease of removal of the upper tray from the lower tray. Various configurations of cover may be used such as a sleeve, carton or lid. The upper tray may contain the higher value food product.

20 Claims, 3 Drawing Sheets

(56) References Cited

U.S. PATENT DOCUMENTS

| | | | | |
|---|---|---|---|---|
| 2003/0155354 | A1* | 8/2003 | Tucker | B65D 21/0222 220/4.24 |
| 2004/0058038 | A1* | 3/2004 | Lee | A47J 47/14 426/107 |

* cited by examiner

FOOD TRAY

BACKGROUND OF THE INVENTION

Food trays for holding and heating a food product are well known. One type in common use has a single compartment. When a pasta or other low value product is heated for consumption in the single compartment, any sauce, which may contain meat and or vegetables, is layered on top or beside of the low value product. Heating of the food arranged in this manner causes the flavours to blend and textures to deteriorate. Another food tray has two compartments, one beside the other. Heating does not cause blending of flavour, but having to spoon sauce from one compartment to another for consumption by the customer is inconvenient.

In another food tray available in Europe from InterFrost GmbH, a smaller paperboard tray is nested snugly within a larger paperboard tray. The two trays fit tightly together. Sauce may be placed in the smaller tray, and pasta or rice in the larger tray. Upon heating of the InterFrost food tray, steam may build up in the lower tray, and may be released suddenly when the smaller tray is removed from the larger tray. In addition, due to the close tight fit of the smaller tray in the larger tray, the smaller tray tends to stick in the larger tray, and pulling on the smaller tray can result in a sudden release of the smaller tray, causing a risk of spilling hot food product from the smaller tray. The steam and heat generated from the lower tray may cause the upper tray to deconstruct, which increases the probability of spillage. Risk of steam release and hot food spill makes the food tray somewhat of a hazard to use.

SUMMARY OF THE INVENTION

The food tray of the present invention is intended to provide the advantages of separate heating of low and high value food products, while reducing the risk of spillage and steam release. In addition, the food tray of the present invention is convenient to use, and provides a pleasing aspect to the user.

Therefore, according to an aspect of the invention, there is provided a food tray, comprising a lower tray containing a first food product and an upper tray nested stably at least partly inside the lower tray, with the upper tray containing a second food product. An air permeable interface is provided between the upper tray and lower tray to allow venting of steam from the lower tray during cooking. A cover is provided for the upper food tray. Each of the lower tray and the upper tray are preferably formed of a material that is suitable for use in a microwave oven. Various constructions may be used to create the air permeable interface, such as lugs, ledges and lips. The upper tray may sit above the lower tray. The trays are preferably nested loosely for ease of removal of the upper tray from the lower tray. Various configurations of cover may be used such as a sleeve, carton, lid or plastic film. The upper tray may contain the higher value food product.

According to a further aspect of the invention, there is provided a method of cooking food products of different value, the method comprising the steps of providing a food tray comprising a first food product in a lower tray and a second food product in an upper tray nested loosely in the lower tray; and subjecting the food tray to food heating energy while permitting steam to escape from the lower tray.

These and other aspects of the invention are set out in the claims, which are incorporated here by reference.

BRIEF DESCRIPTION OF THE FIGURES

Preferred embodiments of the invention will now be described with reference to the figures, in which like reference characters denote like elements, by way of example, and in which.

DETAILED DESCRIPTION OF PREFERRED EMBODIMENTS

In the claims, the word "comprising" is used in its inclusive sense and does not exclude other elements being present. The indefinite article "a" before a claim feature does not exclude more than one of the feature being present.

Figure 1:
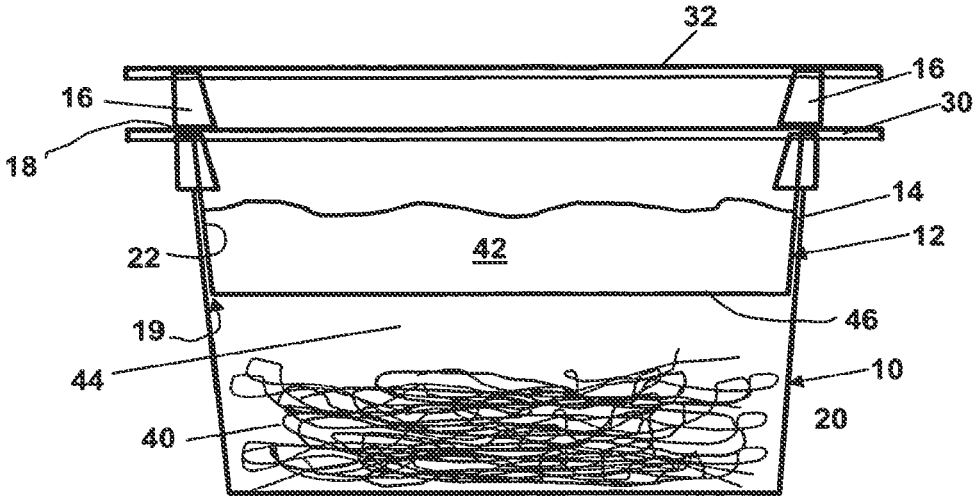
FIG. 1 is a section through a food tray comprising an upper tray and lower tray according to an embodiment of the invention.
Figure 2:
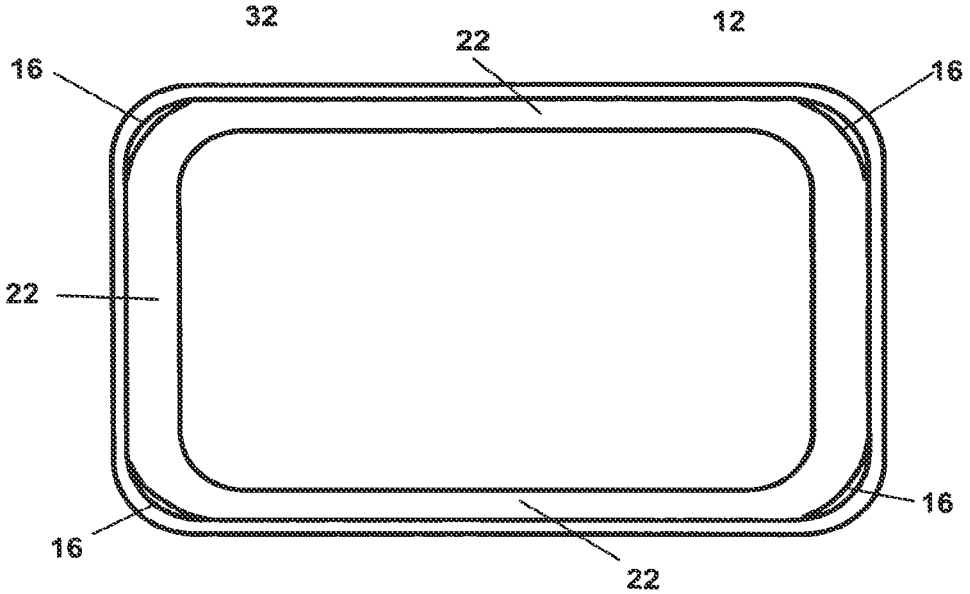
FIG. 2 is a top view of the food tray of FIG. 1.

As shown in FIGS. 1 and 2, a food tray is formed from a lower tray 10 and an upper tray 12 nested stably at least partly inside the lower tray 10. An air permeable interface 14 is provided between the upper tray 12 and lower tray 10 by outwardly extending lugs 16 at the corners of the upper tray 12. The lugs 16 rest on top of the upper edge 18 of the lower tray 10 with a gap 19 between the upper tray 12 and lower tray 10. The gap 19 may extend around the perimeter of the lower tray 12. With a gap between the lower tray 10 and upper tray 12, when product in the lower tray 10 is heated, any steam produced can vent through the gap 19.

The lugs 16 and gap 19 permit the upper tray 12 to sit loosely on the lower tray 10. The only force retarding removal of the upper tray 12 from the lower tray 10 is the force of gravity on the upper tray 12 and its contents. Removal of the upper tray 12 from the lower tray 10 is therefore frictionless. The lugs 16 are at the corners of the upper tray 12 as shown, but may be anywhere around the periphery of the upper tray 12. Four lugs are convenient, and there should be a sufficient number of lugs suitably spaced around the periphery of the upper tray 12 so that the upper tray is stable, and is resistant against tipping. To assist stability, the lugs 16 should be near the top of the upper tray 12 so that the main mass of the upper tray 12 and its contents are below the lugs 16.

Both the upper tray 12 and lower tray 10 include respective lips 32 and 30. The lips 32, 30 should be at least 3 mm wide for easy of sealing.

Each of the lower tray 10 and upper tray 12 may be made by injection moulding, thermoforming or any other suitable manufacturing process. The sidewalls 20 of the lower tray 10 and the sidewalls 22 of the upper tray 12 each may have the same nesting angle. The nesting angle of a tray is the angle between the sidewalls and a perpendicular to the plane defined by the upper edge of the tray. The upper tray 12 may be made in the same mould as the lower tray 10, but with an insert in the mould to reduce the volume. The upper tray 12 and the lower tray 10 should be formed of a material that is suitable for use in a microwave oven, and also may be formed of a material suitable for use in a conventional oven. Exemplary materials are paper, polypropylene (microwave only) and dual use CPET (crystalline polyethylene terephthalate) available from a number of manufacturers. CPET is particularly suitable due to its wide temperature tolerance. The trays 10, 12 may be transparent or opaque.

Figure 3:
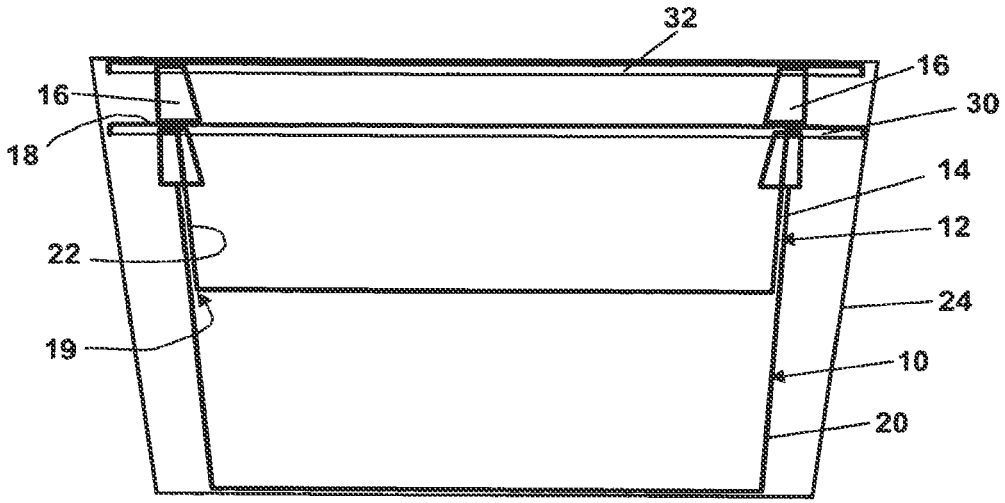
FIG. 3 shows the food tray of FIG. 1 with a cover.

As shown in FIG. 3, the food tray is preferably provided with a cover 24, such as a sleeve. The sleeve may be a paperboard sleeve into which the combined trays 10 and 12 are inserted. The cover 24 could also be a carton that encloses both trays 10 and 12 completely.

Figure 4:
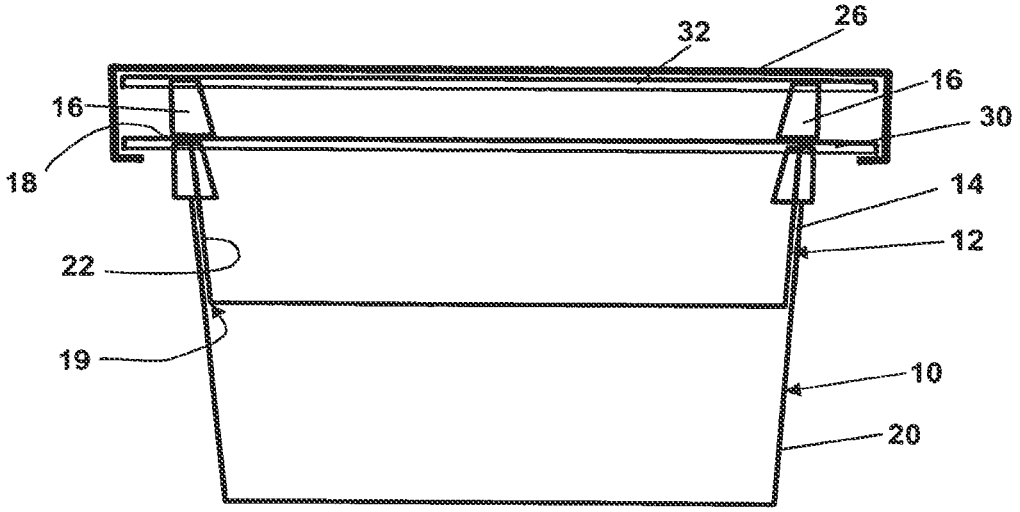
FIG. 4 shows an embodiment of the invention with a snap-on cover.
Figure 5:
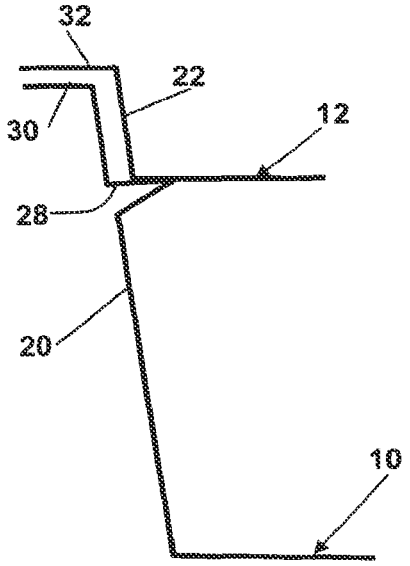
FIG. 5 is a section through a further embodiment of a food tray according to the invention.

As shown in FIG. 4, the cover may comprise a snap-on microwavable lid 26 for the upper tray 12. The lid 26 may extend over the lip 20 on the lower tray 10. The cover 24 may also include a film that is heat sealed to the lip 32 on the upper tray 12. The film may be on the underside of a cardboard sleeve, or a stand alone cover heat sealed to the lip 32.

Figure 6:
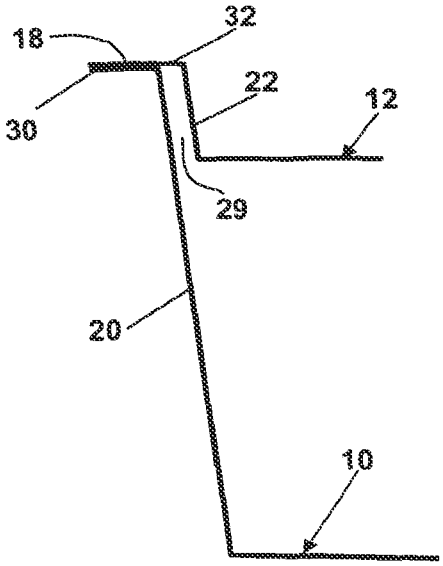
FIG. 6 is a section through a still further embodiment of a food tray according to the invention.
Figure 7:
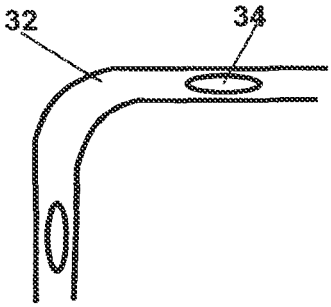
FIG. 7 is a top view of the upper food tray shown in FIG. 6.

As shown in FIG. 4, the air permeable interface may be formed by a seat created by lugs or ledges 28 formed in the sidewalls 20 of the lower tray 10 and spaced around the periphery of the lower tray 10, with the upper tray 12 resting directly on the lugs or ledges 28. Preferably, the lugs or ledges 28 are discontinuous or provided with openings to allow the escape of steam during cooking. As shown in FIG. 6, the air permeable interface may be formed by the lip 32 resting directly on the upper edge 18 of the lower tray 10. In this case, as shown in FIG. 7, the lip 32 is preferably provided with protrusions 34 for allowing steam release. In each of these cases, it is preferable that the air permeable interface supports the upper tray 12 in the lower tray 10 so that the lip 32 of the upper tray 12 sits above the lower tray 10. In the example of FIG. 7, the outwardly extending lip 32 of the upper tray 12 sits loosely on the upper edge 18 of the lower tray 10 to form the air permeable interface with a gap 29 between the side walls 22 of the upper tray 12 and the sidewalls 20 of the lower tray 10. The upper tray 12 and lower tray 10 may also have fluted sides to allow venting of steam during cooking. In another embodiment, the upper tray 12 may sit entirely within the lower tray 10 on lugs or ledges, with a handle provided on the upper tray 12 to allow the upper tray 12 to be easily removed from the lower tray 10.

Food is placed in each of the upper tray 12 and lower tray 10. The food product 42 in the upper tray 12 may be a higher value food product in terms of cost per weight than the food product 40 in the lower tray 10. Thus the lower tray 10 may include pasta, rice or vegetable, which is usually the higher volume product The upper tray 12 may include a sauce, such as cheese sauce, meat or seafood sauce, or vegetable sauce. Water may be added to the lower tray 10 to assist in cooking the food product in the lower tray 10. Preferably, a gap 44 is provided between the top of the food product 40 and the bottom 46 of the upper food tray 12 to avoid the food product 40 coming into contact with the bottom 46 of the upper food tray 12. In another embodiment, chili may be placed in the lower tray 10 and a biscuit in the upper tray 12. For food product such as a biscuit that should have a crisp exterior texture when cooked, a susceptor board may be placed in the tray with the food product.

When sold, the food tray, including food, may be wrapped in shrink wrap. For use, the customer removes the shrink wrap and deposits the food tray in an oven (conventional or microwave as appropriate for the materials), where the food tray is subject to food heating energy. If the upper tray 12 is sealed with a film, it may be removed or loosened prior to cooking depending on the cooking instructions. Due to the air permeable interface 14, the food tray permits steam to escape from the lower tray. Upon removal of the food tray from the oven, the higher value food product may be added to the lower value food product, simply by pouring the higher value food product into the lower tray. Due to the product being in separate trays, quicker more even heating is obtained. With the higher value product in the top tray, the aromas of the higher value product are easily available to the customer upon heating, and the higher value product also presents a pleasing aspect to the customer.

Either or both the cover 24 or the sidewalls 20, 22 may be provided with graphics illustrating the food product and providing instructions for use. In addition, there may be a stack of upper trays, all nested one above the other in like manner as upper tray 12 is nested in lower tray 10. The additional upper trays may conveniently have the same structure as the upper tray 12, and may contain different food products from those in upper tray 12, lower tray 10 or the other upper trays.

Immaterial modifications may be made to the embodiments of the invention described here without departing from the invention.

What is claimed is:

1. A prepackaged microwavable food product comprising:

a first food product;

a second food product;

a lower tray holding the first food product, the lower tray having a lower tray bottom, a lower tray sidewall extending upwardly from the lower tray bottom and a lower tray lip extending around the upper edge of the lower tray sidewall;

an upper tray holding the second food product, the upper tray having an upper tray bottom, an upper tray sidewall extending upwardly from the upper tray bottom and an upper tray lip extending around the upper edge of the upper tray sidewall; and a plurality of outwardly extending lugs formed under the upper tray lip, wherein the plurality of outwardly extending lugs rest on the top of the lower tray lip to form an air permeable gap between the upper tray and the lower tray, the upper tray lip thereby sitting above an entirety of the lower tray lip.

2. The prepackaged microwave food product of claim 1, further comprising a second plurality of outwardly extending lugs formed under the lower tray lip.

3. The prepackaged microwave food product of claim 1, wherein the plurality of outwardly extending lugs is four lugs.

4. The prepackaged microwave food product of claim 3, wherein each of the four lugs is positioned at a respective corner of the upper tray.

5. The prepackaged microwave food product of claim 1, wherein the lower tray and the upper tray are made by at least one member of a group consisting of: injection molding, and thermoforming.

6. The prepackaged microwave food product of claim 1, wherein the material of the upper tray includes at least one member of a group consisting of: paper, polypropylene and crystalline polyethylene terephthalate.

7. The prepackaged microwave food product of claim 1, wherein the upper tray and the lower tray have the same nesting angle.

8. The prepackaged microwave food product of claim 1, further comprising a cover.

9. The prepackaged microwave food product of claim 8, wherein the cover includes a sleeve.

10. The prepackaged microwave food product of claim 8, wherein the cover includes a carton, wherein the carton encloses both the upper tray and the lower tray.

11. The prepackaged microwave food product of claim 8, wherein the cover includes a snap-on microwave lid that extends around the lower tray lip.

12. The prepackaged microwave food product of claim 8, wherein the cover includes a film heat sealed to the upper and lower tray lip.

13. A container system comprising:

a lower tray, the lower tray having a lower tray bottom, a lower tray sidewall extending upwardly from the lower tray bottom and a lower tray lip extending around the upper edge of the lower tray sidewall;

an upper tray, the upper tray having an upper tray bottom, an upper tray sidewall extending upwardly from the upper tray bottom and an upper tray lip extending around the upper edge of the upper tray sidewall; and a plurality of outwardly extending lugs formed under the upper tray lip, wherein the plurality of outwardly extending lugs rest on the top of the lower tray lip to form an air permeable gap between the upper tray and the lower tray, the upper tray lip thereby sitting above an entirety of the lower tray lip.

14. The container system of claim 13, further comprising a second plurality of outwardly extending lugs formed under the lower tray lip.

15. The container system of claim 13, wherein the plurality of outwardly extending lugs is four lugs.

16. The container system of claim 15, wherein each of the four lugs is positioned at a respective corner of the upper tray.

17. A container system comprising:

a lower tray, the lower tray having a lower tray bottom, a lower tray sidewall extending upwardly from the lower tray bottom and a lower tray lip extending around the upper edge of the lower tray sidewall;

an upper tray, the upper tray having an upper tray bottom, an upper tray sidewall extending upwardly from the upper tray bottom and an upper tray lip extending around the upper edge of the upper tray sidewall;

a plurality of outwardly extending lugs formed under the upper tray lip, wherein the plurality of outwardly extending lugs rest on the top of the lower tray lip to form an air permeable gap between the upper tray and the lower tray, the upper tray lip thereby sitting above an entirety of the lower tray lip; and a cover.

18. The container system of claim 17, further comprising a second plurality of outwardly extending lugs formed under the lower tray lip.

19. The container system of claim 17, wherein the plurality of outwardly extending lugs is four lugs.

20. The container of claim 17, wherein the cover is at least one member of a group consisting of: a sleeve, a carton, a snap-on lid, and a film.

* * * * *